US010555083B2

(12) United States Patent
Usui et al.

(10) Patent No.: US 10,555,083 B2
(45) Date of Patent: Feb. 4, 2020

(54) CONNECTION STATE DETERMINATION SYSTEM FOR SPEAKERS, ACOUSTIC DEVICE, AND CONNECTION STATE DETERMINATION METHOD FOR SPEAKERS

(71) Applicant: YAMAHA CORPORATION, Hamamatsu-shi (JP)

(72) Inventors: Atsushi Usui, Hamamatsu (JP); Kenji Kawano, Hamamatsu (JP); Kotaro Nakabayashi, Hamamatsu (JP); Ryota Sato, Hamamatsu (JP); Kohei Sekiguchi, Hamamatsu (JP); Masaya Kano, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/294,006

(22) Filed: Mar. 6, 2019

(65) Prior Publication Data

US 2019/0281388 A1 Sep. 12, 2019

(30) Foreign Application Priority Data

Mar. 8, 2018 (JP) ..... 2018-041575

(51) Int. Cl.
*H04R 5/04* (2006.01)
*H04R 5/027* (2006.01)
*H04S 7/00* (2006.01)

(52) U.S. Cl.
CPC ..... *H04R 5/04* (2013.01); *H04R 5/027* (2013.01); *H04S 7/301* (2013.01); *H04R 2420/01* (2013.01); *H04R 2420/03* (2013.01)

(58) Field of Classification Search
CPC ..... H04R 5/04; H04R 5/027; H04R 2420/01; H04R 2420/03; H04S 7/301
See application file for complete search history.

(56) References Cited

U.S. PATENT DOCUMENTS 5,581,621 A * 12/1996 Koyama ..... H04S 7/301 381/103
2015/0139430 A1* 5/2015 Miyata ..... H04R 29/002 381/56

FOREIGN PATENT DOCUMENTS

WO 2008126161 A1 10/2008

OTHER PUBLICATIONS

Extended European Search Report issued in European Appln. No. 19161250.6 dated Aug. 9, 2019.

* cited by examiner

*Primary Examiner* — Andrew L Sniezek
(74) *Attorney, Agent, or Firm* — Rossi, Kimms & McDowell LLP

(57) ABSTRACT

An acoustic device includes: at least one processor, and at least one memory device that stores a plurality of instructions, which when executed by the at least one processor, causes the at least one processor to operate to: acquire data on a mixed sound of a reproduction sound of a first sound data output from a first speaker and a reproduction sound of a second sound data output from a second speaker, the mixed sound being picked up by a sound pickup device directed toward the first speaker, calculate a first similarity degree indicating similarity between the data on the mixed sound and the first sound data and a second similarity degree indicating similarity between the data on the mixed sound and the second sound data, and determine connection states of the first speaker and the second speaker based on the first similarity degree and the second similarity degree.

20 Claims, 6 Drawing Sheets

CONNECTION STATE DETERMINATION SYSTEM FOR SPEAKERS, ACOUSTIC DEVICE, AND CONNECTION STATE DETERMINATION METHOD FOR SPEAKERS

CROSS-REFERENCE TO RELATED APPLICATION

The present application claims priority from Japanese application JP 2018-041575 filed on Mar. 8, 2018, the content of which is hereby incorporated by reference into this application.

BACKGROUND

1. Technical Field

This disclosure relates to a connection state determination system for speakers, an acoustic device, and a connection state determination method for speakers.

2. Description of the Related Art

In WO 2008/126161 A1, there is disclosed a multi-channel reproduction system including a plurality of speakers. In the multi-channel reproduction system disclosed in WO 2008/126161 A1, an impulse measurement sound is output from a plurality of speakers in order one by one, and the output sound is picked up at a plurality of positions, to thereby determine positions of those plurality of speakers. Once the positions of the speakers are identified, channels of a reproduction sound can be correctly assigned to the respective speakers.

However, with such a related-art configuration, in order to determine the positions of the respective speakers, it is required to output a measurement sound from a plurality of speakers in order one by one, which requires much time for the determination. As a result, it also requires much time to assign channels to the speakers.

SUMMARY

This disclosure has been made in view of the above-mentioned background, and has an object to determine current connection states of a plurality of speakers configured to perform stereo reproduction or multi-channel reproduction in terms of connection to an acoustic device in a short period of time.

A connection state determination system for speakers according to an aspect of the present disclosure includes: at least one processor, and at least one memory device that stores a plurality of instructions, which when executed by the at least one processor, causes the at least one processor to operate to: acquire data on a mixed sound of a reproduction sound of a first piece of sound data output from a first speaker and a reproduction sound of a second piece of sound data output from a second speaker, the mixed sound being picked up by a sound pickup device directed toward the first speaker, calculate each of a first similarity degree indicating similarity between the data on the mixed sound and the first piece of sound data and a second similarity degree indicating similarity between the data on the mixed sound and the second piece of sound data, and determine connection states of the first speaker and the second speaker based on the first similarity degree and the second similarity degree.

An acoustic device according to an aspect of the present disclosure includes: at least one processor, and at least one memory device that stores a plurality of instructions, which when executed by the at least one processor, causes the at least one processor to operate to: acquire data on a mixed sound of a reproduction sound of a first piece of sound data output from a first speaker and a reproduction sound of a second piece of sound data output from a second speaker, the mixed sound being picked up by a sound pickup device directed toward the first speaker, calculate each of a first similarity degree indicating similarity between the data on the mixed sound and the first piece of sound data and a second similarity degree indicating similarity between the data on the mixed sound and the second piece of sound data, and determine connection states of the first speaker and the second speaker based on the first similarity degree and the second similarity degree.

A connection state determination method for speakers according to an aspect of the present disclosure includes: acquiring, with at least one processor operating with a memory device in a device, data on a mixed sound of a reproduction sound of a first piece of sound data output from a first speaker and a reproduction sound of a second piece of sound data output from a second speaker, the mixed sound being acquired by a sound pickup device directed toward the first speaker; calculating, with the at least one processor operating with the memory device in the device, each of a first similarity degree indicating similarity between the data on the mixed sound and the first piece of sound data and a second similarity degree indicating similarity between the data on the mixed sound and the second piece of sound data, and determining, with the at least one processor operating with the memory device in the device, connection states of the first speaker and the second speaker based on the first similarity degree and the second similarity degree.

DETAILED DESCRIPTION

Figure 1:
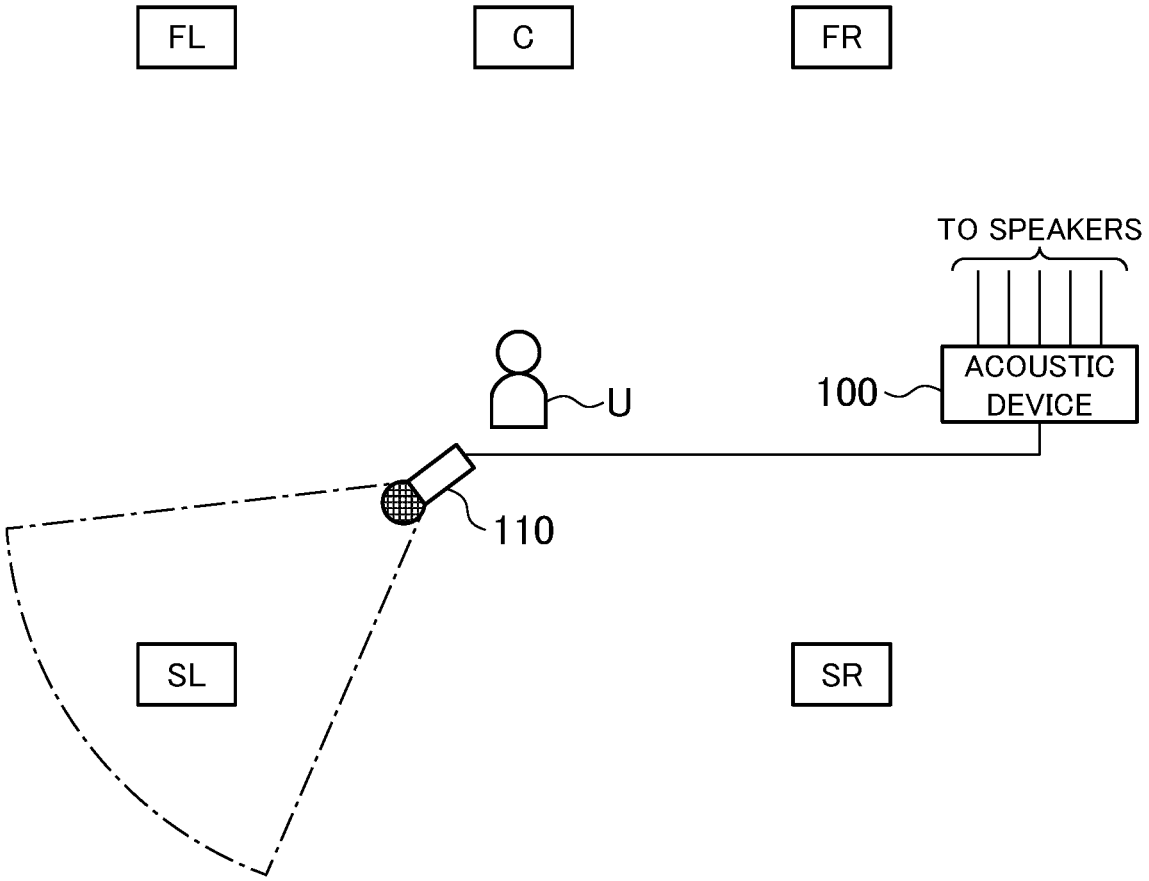
FIG. 1 is a schematic diagram for illustrating a layout example of speakers and a microphone in a room.

FIG. 1 is a schematic diagram for illustrating an audio-visual (AV) system including a connection state determination system for speakers according to one embodiment of this disclosure. The AV system is installed in an AV listening-and-viewing space in a home, and includes an AV receiver or other such acoustic device 100, and a front left speaker FL, a front right speaker FR, a center speaker C, a surround left speaker SL, and a surround right speaker SR, which are connected to the acoustic device 100. A user U being a listener is positioned in a central vicinity of the space, and those speakers are arranged around the user U. The acoustic device 100 may be connected to a subwoofer or other such speaker. The acoustic device 100 is also connected to a portable directional microphone 110, which is positioned near the user U. The acoustic device 100 is configured to reproduce video, music, or other such content, and output sounds of a plurality of channels included in the content from the speakers corresponding to the respective channels. The directional microphone 110 may be placed on a floor or a table, or may be held by a hand of the user U.

In this case, the front left speaker FL is set on the front left side of the user U, the front right speaker FR is set on the front right side of the user U, and the center speaker C is set at the center on the front side of the user U. The front left speaker FL, the front right speaker FR, and the center speaker C may be separate individual speakers, or may be unitarily formed as, for example, a sound bar.

In addition, the surround left speaker SL is set on the left rear side of the user U, and the surround right speaker SR is set on the right rear side of the user U.

The acoustic device 100 includes speaker terminals corresponding to the respective plurality of channels, and the above-mentioned five speakers are connected to the corresponding speaker terminals. Acoustic signals of mutually different sound channels included in one piece of video, music, or other such content are sent to those speakers from the acoustic device 100, and the respective speakers output the sounds of the corresponding channels. The acoustic device 100 may perform 5.1-channel multi-channel reproduction through use of the five speakers illustrated in FIG. 1 and the subwoofer (not shown).

In the embodiment of this disclosure, the acoustic device 100 particularly performs connection state determination processing for speakers for determining the connection states of speakers based on data on sounds recorded by the microphone 110 and data on sounds of the respective channels included in the reproduction content. That is, the acoustic device 100 includes the connection state determination system for speakers according to the embodiment of this disclosure. In this case, a description is given of an example in which the connection state determination processing for speakers is performed in the AV system including five speakers. However, the connection state determination system and method for speakers according to the embodiment of this disclosure may be applied in the same manner to an AV system including a freely-selected number of speakers as long as the number is at least two.

When the surround left speaker SL is correctly connected to a surround left (SL) terminal among the speaker terminals (not shown) of the acoustic device 100 and the surround right speaker SR is correctly connected to a surround right (SR) terminal among the speaker terminals of the acoustic device 100, the sound of the surround left (SL) channel is output from the surround left speaker SL, and the sound of the surround right (SR) channel is output from the surround right speaker SR. However, when the surround left speaker SL is erroneously connected to the SR terminal and the surround right speaker SR is erroneously connected to the SL terminal, the sound of the SR channel is output from the surround left speaker SL, and the sound of the SL channel is output from the surround right speaker SR.

In view of the foregoing, in the connection state determination processing for speakers to be performed by the acoustic device 100, information relating to the connection states of the surround left speaker SL and the surround right speaker SR is generated based on the data on the sound recorded by the microphone 110 and the data on the sounds of the SL channel and the SR channel included in the reproduction content on the assumption that the user U directs the microphone 110 toward a desired speaker (in this case, the surround left speaker SL). Specifically, it is determined whether or not the surround left speaker SL is set on the frontside of the microphone 110 and the surround right speaker SR is set at such a position other than the front side of the microphone as to be spaced apart from the surround left speaker SL. When the determination is positive, it is determined that the surround left speaker SL and the surround right speaker SR are correctly connected to the acoustic device 100.

Meanwhile, when the determination is negative, it is determined that the surround left speaker SL and the surround right speaker SR are erroneously connected to the acoustic device 100. In this case, the acoustic device 100 outputs a sound signal of the SL channel from the SR terminal to which the surround left speaker SL is connected, and outputs a sound signal of the SR channel from the SL terminal to which the surround right speaker SR is connected. In this manner, even when the surround left speaker SL and the surround right speaker SR are erroneously connected to the acoustic device 100, the sounds of the correct channels can be output from the speakers set at the respective positions.

Figure 2A:
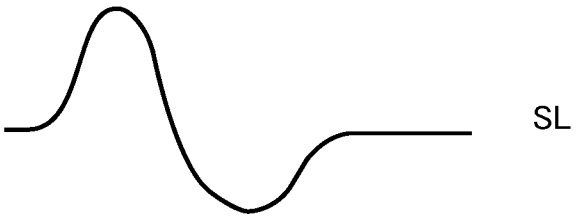
FIG. 2A is a diagram for illustrating a waveform of a sound output from a surround left speaker.
Figure 2B:
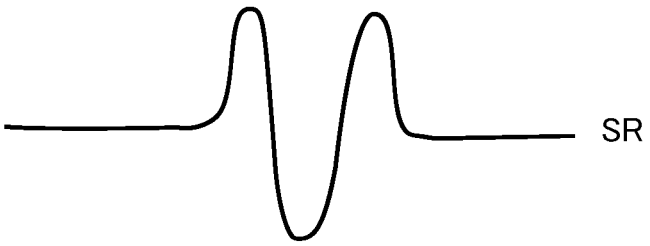
FIG. 2B is a diagram for illustrating a waveform of a sound output from a surround right speaker.
Figure 2C:
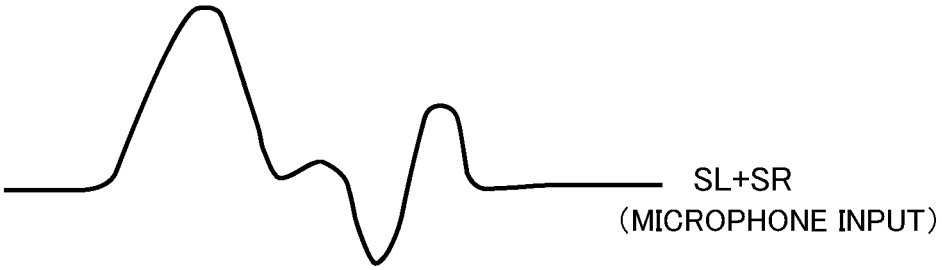
FIG. 2C is a diagram for illustrating a waveform of a mixed sound picked up by the microphone.

Now, a basic idea of the connection state determination processing for speakers is described. When a sound output from the surround left speaker SL has a waveform illustrated in FIG. 2A and a sound output from the surround right speaker SR has a waveform illustrated in FIG. 2B, a sound picked up by the microphone 110 has a waveform illustrated in FIG. 2C. The microphone 110 picks up a mixed sound of the sound output from the surround left speaker SL and the sound output from the surround right speaker SR. In this case, the microphone 110, which has directivity, picks up a sound that has arrived from a sound generator in a predetermined direction, for example, on the front side of the microphone 110, with a relatively large volume, and picks up a sound that has arrived from a sound generator in a direction other than the predetermined direction with a relatively small volume. Therefore, the sound picked up by the microphone 110 includes the sound output from the surround left speaker SL and the sound output from the surround right speaker SR so that the former has a volume larger than that of the latter. Therefore, when the connection states of the speakers are normal, a similarity degree $\alpha L$ indicating similarity between the waveform illustrated in FIG. 2A and the waveform illustrated in FIG. 2C (indicating how similar the two waveforms are) is larger than a similarity degree $\alpha R$ indicating similarity between the waveform illustrated in FIG. 2B and the waveform illustrated in FIG. 2C. In this case, each of the similarity degrees $\alpha L$ and $\alpha R$ may be a maximum value of a cross-correlation function of the two waveforms (convolution integral of the two waveforms shifted by a variable $\tau$), or may be determined through use of another function for evaluating a similarity degree between the two waveforms. According to the processing in the embodiment of this disclosure, when a similarity degree between the waveform of a sound to be output from a speaker set in the direction of the microphone 110 and the waveform of a mixed sound acquired by the microphone 110 is larger than a similarity degree between the waveform of a sound to be output from another speaker and the waveform of a mixed sound acquired by the microphone 110, it is determined that the speaker set in the direction of the microphone 110 is correctly connected.

Figure 3:
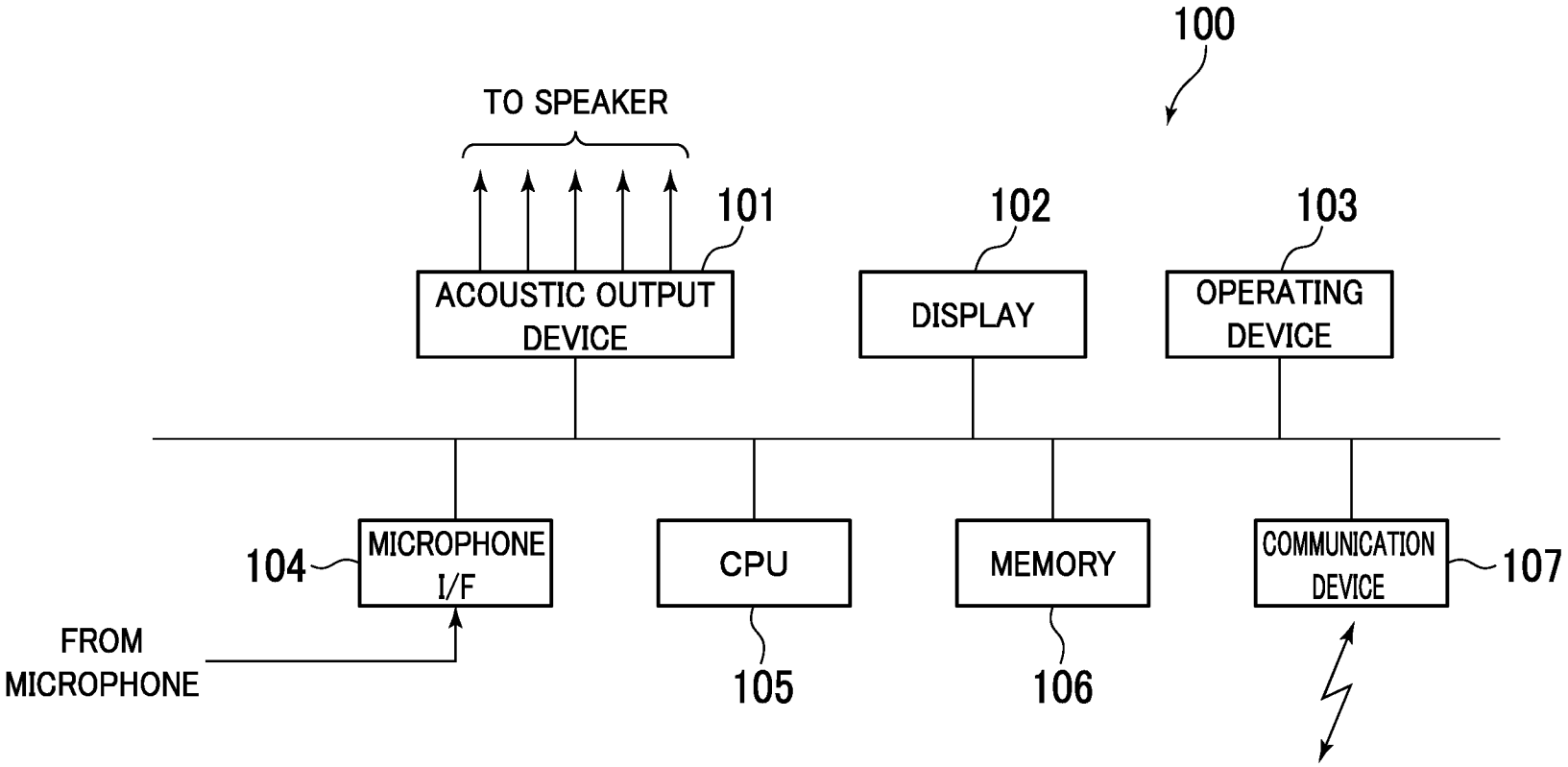
FIG. 3 is a diagram for illustrating a hardware configuration example of an acoustic device.

FIG. 3 is a diagram for illustrating a hardware configuration of the acoustic device 100. As illustrated in FIG. 3, the acoustic device 100 includes an acoustic output device 101, a display 102, an operating device 103, a microphone interface 104, a CPU 105, a memory 106, and a communication device 107, which are connected to a bus. That is, the acoustic device 100 includes the CPU 105 and the memory 106, and functions as a computer.

The acoustic output device 101 reads content from a CD, a DVD, a Blu-ray disc, or other such medium, or receives content via the communication device 107, and reproduces the content acquired in this manner. At this time, the acoustic output device 101 converts sound data on a plurality of channels included in the acquired content into sound signals, and outputs the sound signals from the speaker terminals of the respective channels. In this case, the respective speakers are assumed to be connected to the physical speaker terminals by cables, but may be connected to the acoustic output device 101 through use of wireless communication performed by the communication device 107. Even in this case, any one of the plurality of channels included in the content is logically assigned to each of the speakers. Further, the connection state determination processing for speakers according to the embodiment of this disclosure may be applied not only to the case of the connection based on the cable but also to the case of the connection based on the wireless communication.

The display 102 includes a liquid crystal display (LCD), an organic light emitting diode (OLED), or other such display device, and displays various kinds of information based on an instruction received from the CPU 105. The operating device 103 is provided with a physical key or a touch panel, and is used by the user U to operate the acoustic device 100.

The microphone interface 104 includes a microphone terminal and an analog-digital converter, and converts an analog sound signal input from the microphone 110 into a digital format. The sound data generated through the conversion is passed to the CPU 105. The microphone 110 may be connected to the acoustic device 100 through use of the wireless communication performed by the communication device 107. In this case, the acoustic device 100 may receive the digital-format sound data from the microphone 110. For example, the microphone 110 may be a built-in microphone of a smartphone, a tablet computer, or other such portable computer, and in this case, the digital-format sound data generated through use of the built-in microphone is transmitted to the acoustic device 100 from the portable computer via, for example, a wireless LAN or a public telephone network.

The CPU 105 controls the respective components of the acoustic device 100 based on a built-in program. In particular, the CPU 105 performs the above-mentioned connection state determination processing for speakers based on the built-in program. The memory 106 stores the built-in program, or reserves a work area for the CPU 105. The communication device 107 includes a communication module for, for example, a wired LAN or a wireless LAN, and is used to receive content and other such data via the Internet. In addition, when the microphone 110 and the respective speakers are capable of performing wireless communication, the communication device 107 may be used for data communication thereto/therefrom. For example, the built-in program may be downloaded from the Internet through use of the communication device 107, or may be installed from a semiconductor memory or other such external storage medium.

Figure 4:
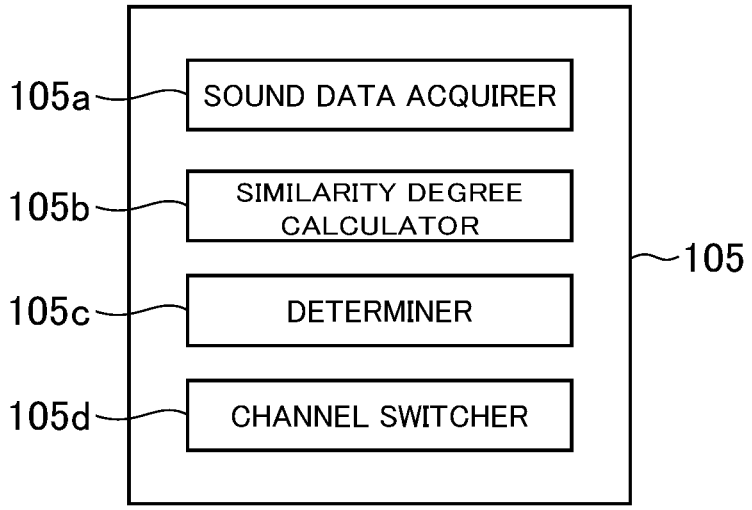
FIG. 4 is a block diagram for functionally illustrating a CPU included in the acoustic device.

FIG. 4 is a block diagram for functionally illustrating the CPU 105 included in the acoustic device 100. In FIG. 4, only functions relating to connection state determination processing for speakers among different kinds of functions implemented by the CPU 105 are illustrated. The functions illustrated in FIG. 4 are implemented by the CPU 105 executing the built-in program stored in the memory 106.

A sound data acquirer 105*a* acquires pickup sound data, which is data on a mixed sound of a reproduction sound of sound data SL output from the surround left speaker SL and a reproduction sound of sound data SR output from the surround right speaker SR, and is picked up by the microphone 110 placed so as to be directed toward the surround left speaker SL. For example, when the above-mentioned pickup sound data is generated by the microphone interface 104 subjecting the sound signal input from the microphone 110 to analog-digital conversion, the sound data acquirer 105*a* acquires the pickup sound data. The sound data acquirer 105*a* also acquires the sound data SL and the sound data SR that are reproduced by the acoustic device 100 over a section in which the sound is picked up by the microphone 110.

A similarity degree calculator 105*b* calculates each of the similarity degree $\alpha L$ indicating the similarity between the pickup sound data and the sound data SL and the similarity degree $\alpha R$ indicating the similarity between the pickup sound data and the sound data SR. A determiner 105*c* determines the connection states of the surround left speaker SL and the surround right speaker SR based on the similarity degree $\alpha L$ and the similarity degree $\alpha R$. For example, the determiner 105*c* determines whether or not the surround left speaker SL and the surround right speaker SR are correctly connected to the SL channel and the SR channel, respectively. In this case, the determiner 105*c* compares the similarity degree $\alpha L$ and the similarity degree $\alpha R$ with each other to determine the connection states of the surround left speaker SL and the surround right speaker SR based on a comparison result thereof.

A channel switcher 105*d* outputs the reproduction sound of the sound data SL from the surround right speaker SR and outputs the reproduction sound of the sound data SR from the surround left speaker SL depending on the determination performed by the determiner 105*c*. In this case, the channel switcher 105*d* instructs the acoustic output device 101 to outputs the sound signal of the SR channel to the SL terminal among the speaker terminals and output the sound signal of the SL channel to the SR terminal. The acoustic output device 101 switches the sound signals to be output to the SL terminal and the SR terminal based on the above-mentioned instruction. The function of the channel switcher 105*d* is not mandatory, and the display 102 may be configured to display a message indicating that the speakers are erroneously connected to prompt the user U to reconnect the speakers. Meanwhile, when the surround left speaker SL and the surround right speaker SR are connected to the acoustic output device 101 through use of the wireless communication performed by the communication device 107, the channel switcher 105*d* instructs the acoustic output device 101 to switch the channels assigned to the respective speakers. With this configuration, the acoustic output device 101 transmits the sound data SR to the surround left speaker SL, and transmits the sound data SL to the surround right speaker SR. In this manner, the reproduction sound of the sound data SR is output from the surround left speaker SL, and the reproduction sound of the sound data SL is output from the surround right speaker SR.

Figure 5:
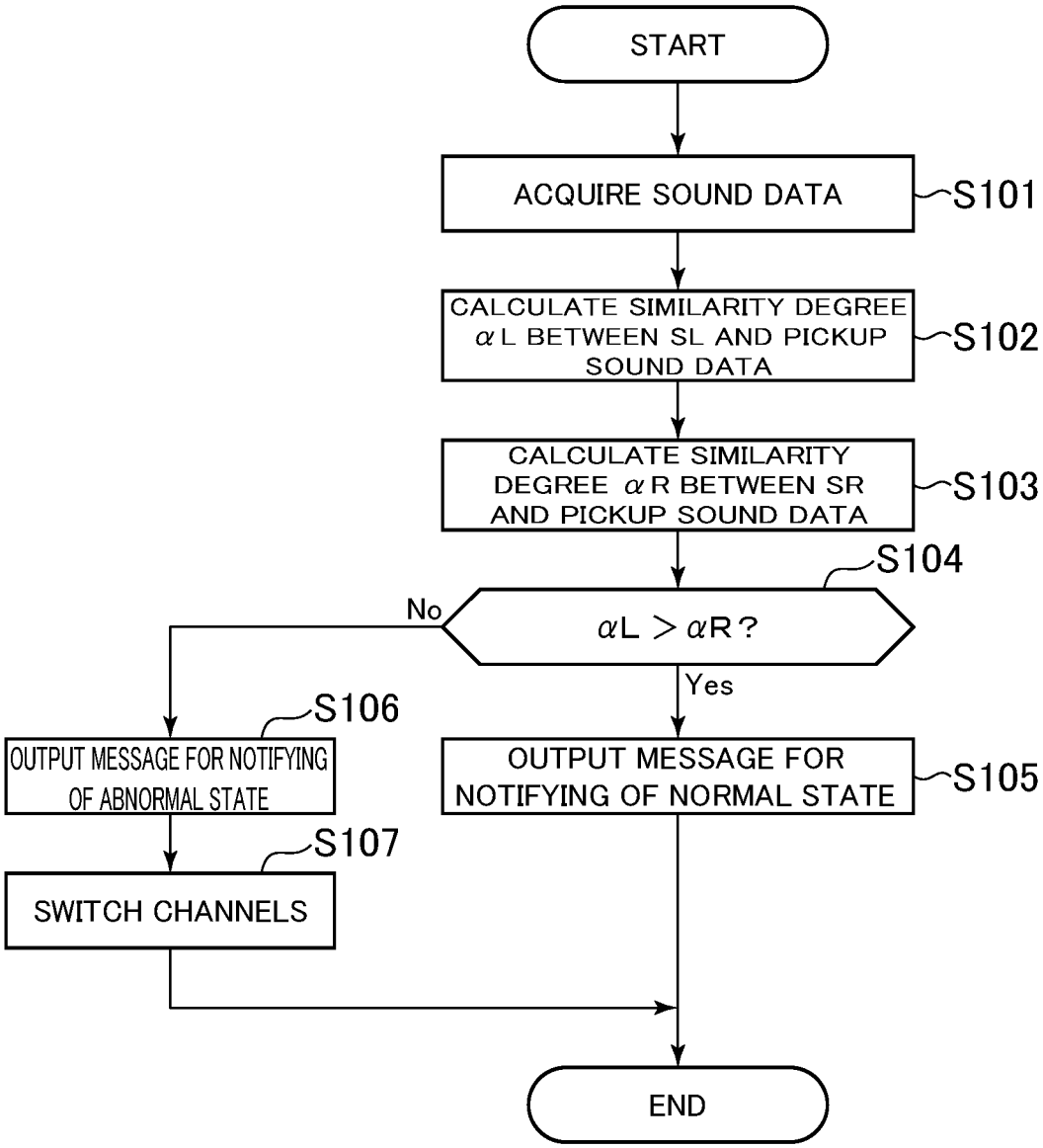
FIG. 5 is a flow chart for illustrating connection state determination processing for speakers to be performed by the acoustic device.

FIG. 5 is a flowchart for illustrating the connection state determination processing for speakers to be performed by the acoustic device 100. As illustrated in FIG. 5, in the connection state determination processing, first, the sound data acquirer 105*a* acquires the pickup sound data of the microphone 110 converted to the digital format, the sound data SL on the SL channel reproduced by the acoustic output device 101 over the section in which the sound is picked up by the microphone 110, and the sound data SR on the SR channel reproduced over the same section (Step S101).

Subsequently, the similarity degree calculator 105*b* calculates the similarity degree αL between the sound data SL and the pickup sound data (Step S102). In the same manner, the similarity degree calculator 105*b* calculates the similarity degree αR between the sound data SR and the pickup sound data (Step S103). Each of those similarity degrees may be the maximum value of the cross-correlation function as described above.

Subsequently, the determiner 105*c* determines whether or not the similarity degree αL is larger than the similarity degree αR (Step S104). When the similarity degree αL is larger, the determiner 105*c* outputs the message "The connection states of the speakers are normal." or other such message to the display 102 (Step S105), and brings the processing to an end. Meanwhile, when the similarity degree αL is equal to or smaller than the similarity degree αR, the determiner 105*c* outputs the message "The connection states of the speakers are abnormal." or other such message to the display 102 (Step S106). In this case, the channel switcher 105*d* instructs the acoustic output device 101 to switch the SL channel and the SR channel (Step S107).

In the above-mentioned manner, it is possible to determine the connection states of the surround left speaker SL and the surround right speaker SR through use of the sound data on the SL channel and the SR channel included in music, video, or other such content in a short period of time. The above-mentioned determination of the connection states is performed on only the surround left speaker SL and the surround right speaker SR, but the connection states of other speakers can be determined in the same manner. That is, when there are N speakers, in the same manner, the microphone 110 is directed toward N−1 speakers of those speakers in order, and the similarity degree between the sound data on the channel corresponding to the direction of the microphone 110 and the pickup sound data and the similarity degree between the sound data on another channel and the pickup sound data are each calculated and compared with each other, to thereby be able to determine the connection states of all the speakers. In another case, N−1 microphones 110 may be provided to simultaneously pick up respective mixed sounds through use of those N−1 microphones 110.

In this case, music, video, or other such content are used to determine the connection states of speakers, but dedicated content may be used to determine the connection states of the speakers. In this case, it is desired to prevent pieces of sound data on the respective channels from becoming similar to each other. In addition, low-frequency sound components tend to reach the microphone 110 from a position in a direction other than a direction toward which the microphone 110 is directed, and hence it is desired that the pieces of sound data on the respective channels have as less low-frequency sound components as possible.

To that end, in the case of using music, video, or other such content to perform the connection state determination for speakers, a high pass filter may be applied to the sound data on the respective channels and the pickup sound data to suppress low frequency spectra thereof. In addition, a similarity degree of the sound data between the respective channels may be calculated to perform the above-mentioned determination only when the similarity degree is smaller than a predetermined value.

Figure 6:
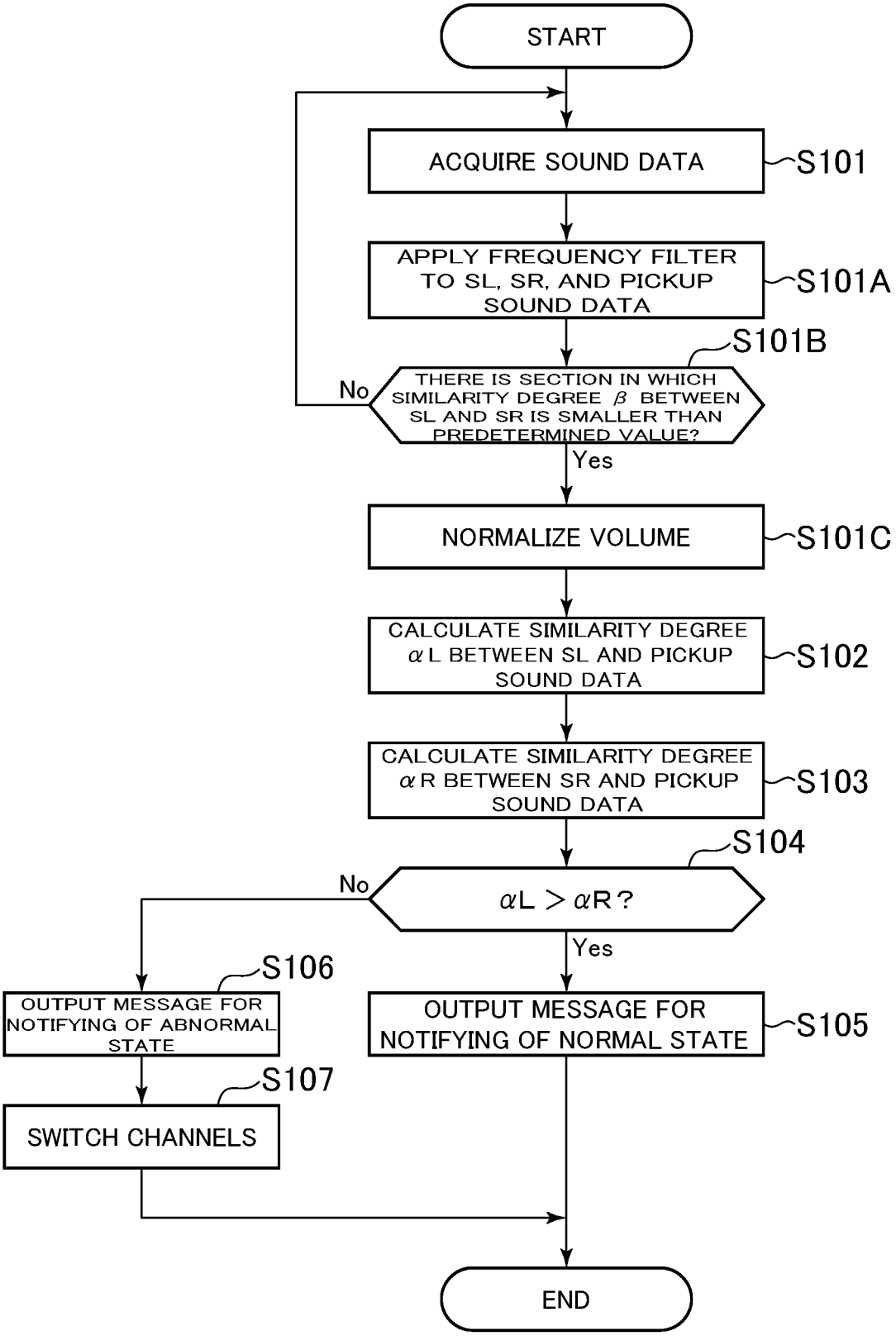
FIG. 6 is a flow chart for illustrating a modification example of the connection state determination processing for speakers to be performed by the acoustic device.

FIG. 6 is a flow chart for illustrating a modification example of the connection state determination processing for speakers to be performed by the acoustic device 100. In FIG. 6, the processing of Step S101 and Step S102 to Step S107 is the same as the corresponding processing of the flow chart illustrated in FIG. 5, and hence a description thereof is omitted below.

In the modification example, the similarity degree calculator 105*b* performs frequency filter (high pass filter) processing for suppressing low frequency spectra of the pickup sound data, the sound data SL, and the sound data SR (Step S101A). Then, the similarity degree calculator 105*b* calculates a similarity degree β between a partial section of the sound data SL to which a frequency filter is applied and the corresponding section of the sound data SR to which the frequency filter is applied. The similarity degree β may also be the maximum value of the above-mentioned cross-correlation function. Then, it is determined whether or not the similarity degree β is smaller than a predetermined value. When the similarity degree β is not smaller than the predetermined value, the similarity degree calculator 105*b* repeatedly performs the same processing while shifting the section of the sound data SL and the sound data SR. In this manner, the similarity degree calculator 105*b* searches for a section in which the similarity degree between the sound data SL and the sound data SR is smaller than the predetermined value (Step S101B). When there is no such section, for example, the message "Use the microphone to pick up sound again." or other such message is displayed by the display 102, to thereby prompt the user to use the microphone 110 to pick up the sound again. After that, the processing of Step S101 and the subsequent steps is executed again.

When it is determined that the section in which the similarity degree is smaller than the predetermined value is included in the sound data SL and the sound data SR acquired in Step S101 (Step S101B), an average volume of the sound data SL and the sound data SR in the same section is calculated. Then, the pickup sound data corresponding to the same section is extracted, and a volume thereof is changed to the above-mentioned average volume. In this manner, the volumes of the sound data SL, the sound data SR, and the pickup sound data are normalized (Step S101C). After that, in the above-mentioned manner, the processing of Step S102 to Step S107 is executed based on the pickup sound data, the sound data SL, and the sound data SR that have been subjected to the extraction of the partial section based on the frequency filter and the similarity degree β and to the normalization.

According to the above-mentioned processing, when the connection state determination for speakers is performed through use of music, video, or other such freely-selected content, it is possible to improve accuracy of the determination.

The description has been given above of the example in which the respective functions illustrated in FIG. 4 are implemented by the acoustic device 100, but a part or all of the functions may be implemented by another device. For example, a built-in microphone of a smartphone, a tablet computer, or other such portable computer may be used as the microphone 110, and a part or all of the functions illustrated in FIG. 4 may be implemented by the portable computer. In another case, a part of the functions may be implemented by a server computer on the Internet (for example, a cloud server).

While there have been described what are at present considered to be certain embodiments of the invention, it will be understood that various modifications may be made thereto, and it is intended that the appended claims cover all such modifications as fall within the true spirit and scope of the invention.

What is claimed is:

1. A connection state determination system including first and second speakers and an acoustic device with output terminals for the first and second speakers, the connection state determination system comprising:

at least one processor; and at least one memory device that stores a plurality of instructions, which when executed by the at least one processor, causes the at least one processor to operate to:

acquire data on a mixed sound of a reproduction sound of a first piece of sound data output from the first speaker and a reproduction sound of a second piece of sound data output from the second speaker, the mixed sound being picked up by a sound pickup device directed toward the first speaker;

calculate each of a first similarity degree indicating similarity between the data on the mixed sound and the first piece of sound data and a second similarity degree indicating similarity between the data on the mixed sound and the second piece of sound data; and determine connection states of the first speaker and the second speaker with respect to the output terminals based on the first similarity degree and the second similarity degree.

2. The connection state determination system according to claim 1, wherein the first piece of sound data and the second piece of sound data each include any one of pieces of sound data on a plurality of channels included in one of music content and video content.

3. The connection state determination system according to claim 1, wherein the at least one processor is configured to perform frequency filter processing for suppressing low frequency spectra of the data on the mixed sound, the first piece of sound data, and the second piece of sound data, and to calculate the first similarity degree and the second similarity degree based on the data on the mixed sound, the first piece of sound data, and the second piece of sound data, which have the low frequency spectra suppressed.

4. The connection state determination system according to claim 1, wherein the at least one processor is configured to compare the first similarity degree and the second similarity degree with each other to determine the connection states of the first speaker and the second speaker based on a result of the comparison.

5. The connection state determination system according to claim 1, wherein the sound pickup device has directivity.

6. The connection state determination system according to claim 1, wherein the at least one processor is configured to output the reproduction sound of the first piece of sound data from the second speaker and output the reproduction sound of the second piece of sound data from the first speaker depending on the determination.

7. The connection state determination system according to claim 1, wherein the at least one processor is configured to:

calculate a third similarity degree indicating similarity between the first piece of sound data and the second piece of sound data; and determine, when the third similarity degree is smaller than a predetermined value, the connection states of the first speaker and the second speaker based on the first similarity degree indicating the similarity between the data on the mixed sound and the first piece of sound data and the second similarity degree indicating the similarity between the data on the mixed sound and the second piece of sound data.

8. An acoustic device with output terminals for first and second speakers, the acoustic device comprising:

at least one processor; and at least one memory device that stores a plurality of instructions, which when executed by the at least one processor, causes the at least one processor to operate to:

acquire data on a mixed sound of a reproduction sound of a first piece of sound data output from the first speaker and a reproduction sound of a second piece of sound data output from the second speaker, the mixed sound being picked up by a sound pickup device directed toward the first speaker;

calculate each of a first similarity degree indicating similarity between the data on the mixed sound and the first piece of sound data and a second similarity degree indicating similarity between the data on the mixed sound and the second piece of sound data; and determine connection states of the first speaker and the second speaker with respect to the output terminals based on the first similarity degree and the second similarity degree.

9. The acoustic device according to claim 8, wherein the first piece of sound data and the second piece of sound data each include any one of pieces of sound data on a plurality of channels included in one of music content and video content.

10. The acoustic device according to claim 8, wherein the at least one processor is configured to perform frequency filter processing for suppressing low frequency spectra of the data on the mixed sound, the first piece of sound data, and the second piece of sound data, and to calculate the first similarity degree and the second similarity degree based on the data on the mixed sound, the first piece of sound data, and the second piece of sound data, which have the low frequency spectra suppressed.

11. The acoustic device according to claim 8, wherein the at least one processor is configured to compare the first similarity degree and the second similarity degree with each other to determine the connection states of the first speaker and the second speaker based on a result of the comparison.

12. The acoustic device according to claim 8, wherein the sound pickup device has directivity.

13. The acoustic device according to claim 8, wherein the at least one processor is configured to output the reproduction sound of the first piece of sound data from the second speaker and output the reproduction sound of the second piece of sound data from the first speaker depending on the determination.

14. A connection state determination method for speakers with respect to output terminals of an acoustic device, the connection state determination method comprising:

acquiring, with at least one processor operating with a memory device in a device, data on a mixed sound of a reproduction sound of a first piece of sound data output from a first speaker and a reproduction sound of a second piece of sound data output from a second speaker, the mixed sound being acquired by a sound pickup device directed toward the first speaker;

calculating, with the at least one processor operating with the memory device in the device, each of a first similarity degree indicating similarity between the data on the mixed sound and the first piece of sound data and a second similarity degree indicating similarity between the data on the mixed sound and the second piece of sound data; and determining, with the at least one processor operating with the memory device in the device, connection states of the first speaker and the second speaker based on the first similarity degree and the second similarity degree.

15. The connection state determination method according to claim 14, wherein the first piece of sound data and the second piece of sound data each include any one of pieces of sound data on a plurality of channels included in one of music content and video content.

16. The connection state determination method according to claim 14, wherein the calculating, with the at least one processor operating with the memory device in the device, includes performing frequency filter processing for suppressing low frequency spectra of the data on the mixed sound, the first piece of sound data, and the second piece of sound data, and calculating the first similarity degree and the second similarity degree based on the data on the mixed sound, the first piece of sound data, and the second piece of sound data, which have the low frequency spectra suppressed.

17. The connection state determination method according to claim 14, wherein the determining, with the at least one processor operating with the memory device in the device, includes comparing the first similarity degree and the second similarity degree with each other to determine the connection states of the first speaker and the second speaker based on a result of the comparison.

18. The connection state determination method according to claim 14, wherein the sound pickup device has directivity.

19. The connection state determination method according to claim 14, further comprising outputting, with the at least one processor operating with the memory device in the device, the reproduction sound of the first piece of sound data from the second speaker and outputting the reproduction sound of the second piece of sound data from the first speaker depending on the determination.

20. The connection state determination method according to claim 14, wherein:

the calculating, with the at least one processor operating with the memory device in the device, includes calculating a third similarity degree indicating similarity between the first piece of sound data and the second piece of sound data, and the determining, with the at least one processor operating with the memory device in the device, includes determining, when the third similarity degree is smaller than a predetermined value, the connection states of the first speaker and the second speaker based on the first similarity degree indicating the similarity between the data on the mixed sound and the first piece of sound data and the second similarity degree indicating the similarity between the data on the mixed sound and the second piece of sound data.

* * * * *